US007582867B2

(12) United States Patent
Wells et al.

(10) Patent No.: US 7,582,867 B2
(45) Date of Patent: Sep. 1, 2009

(54) MASS SPECTROMETERS

(75) Inventors: James Mitchell Wells, Lafayette, IN (US); Garth E. Patterson, Brookston, IN (US)

(73) Assignee: Griffin Analytical Technologies, L.L.C., West Lafayette, IN (US)

( * ) Notice: Subject to any disclaimer, the term of this patent is extended or adjusted under 35 U.S.C. 154(b) by 20 days.

(21) Appl. No.: 11/906,661

(22) Filed: Oct. 3, 2007

(65) Prior Publication Data

US 2008/0128605 A1 Jun. 5, 2008

Related U.S. Application Data

(62) Division of application No. 10/537,019, filed as application No. PCT/US03/38587 on Dec. 2, 2003, now Pat. No. 7,294,832.

(60) Provisional application No. 60/430,223, filed on Dec. 2, 2002.

(51) Int. Cl.
*H01J 49/42* (2006.01)

(52) U.S. Cl. ..... 250/292; 250/281

(58) Field of Classification Search ..... 250/292, 250/281

See application file for complete search history.

(56) References Cited

U.S. PATENT DOCUMENTS

| | | | | |
|---|---|---|---|---|
| 4,540,884 | A | 9/1985 | Stafford et al. | |
| 4,882,484 | A | 11/1989 | Franzen et al. | |
| 5,420,425 | A | 5/1995 | Bier et al. | |
| 5,448,062 | A * | 9/1995 | Cooks et al. | 250/288 |
| 6,133,568 | A | 10/2000 | Weiss et al. | |
| 6,469,298 | B1 | 10/2002 | Ramsey et al. | |
| 6,686,592 | B1 | 2/2004 | Sakairi et al. | |
| 6,759,652 | B2 * | 7/2004 | Yoshinari et al. | 250/292 |
| 6,762,406 | B2 | 7/2004 | Cooks et al. | |

FOREIGN PATENT DOCUMENTS

| | | |
|---|---|---|
| EP | 0 336 990 A1 | 10/1989 |
| EP | 03 81 2512 | 9/2007 |

OTHER PUBLICATIONS

Database WPI week 199921; Derwent Publications Ltd., London, GB; AN 1999-250451; XP002416788.

(Continued)

*Primary Examiner*—Kiet T Nguyen
(74) *Attorney, Agent, or Firm*—Wells St. John P.S.

(57) ABSTRACT

In one implementation, processes for designing mass separators from a series of mass separator electric field data and processes for designing an ion trap from a range of data pairs and a mass analyzer scale are provided. Methods for producing mass separators including ion traps having $Z_0/r_0$ ratios from about 0.84 to about 1.2 are also provided. Mass spectrometers are also provided that can include mass separators in tandem with one being an ion trap having a $Z_0/r_0$ ratio between 0.84 and 1.2. The present invention also provides methods for analyzing samples using mass separators having first and second sets of components defining a volume with a ratio of a distance from the center of the volume to a surface of the first component to a distance from the center of the volume to a surface of the second component being between 0.84 and 1.2.

11 Claims, 12 Drawing Sheets

OTHER PUBLICATIONS

Barlow et al., "Determination of analytic potentials from finite element computations", international Journal of Mass Spectrometry, vol. 207, Apr. 12, 2001, pp. 19-29.

Bollen et al., "ISOLTRAP: a tandem Penning trap system for accurate on-line mass determination of short-lived istopes", Nuclear Instruments & Methods in Physics Research, vol. A368, Jan. 11, 1996, pp. 675-697.

Louris, et al., Instrumentation, Applications , and Energy Deposition in Quadrupole Ion-Trap Tandem Mass Spectrometry, Anal. Chem. 1987, 59, 1677-1685.

Wells, et al., A Quadrupole Ion Trap with Cylindrical Geometry Operated in the Mass-Selective Instability Mode, Anal. Chem 1998, 70, 438-444.

* cited by examiner

MASS SPECTROMETERS

CLAIM FOR PRIORITY

This application is a Divisional application of U.S. patent application Ser. No. 10/537,019, filed Jun. 1, 2005 now U.S. Pat. No. 7,294,832 which is a 35 U.S.C. §371 of and claims priority to PCT International Application Number PCT/US03/38587, which was filed 2 Dec. 2003, and was published in English, which claims priority under 35 U.S.C. §119 to U.S. Provisional Patent Application No. 60/430,223 which was filed 2 Dec. 2002, the entirety of each are incorporated herein by reference.

FIELD OF THE INVENTION

The present invention relates generally to the field of analytical detectors and more specifically to mass spectral ion detectors.

BACKGROUND OF THE INVENTION

Mass spectrometry is a widely applicable analytical tool capable of providing qualitative and quantitative information about the composition of both inorganic and organic samples. Mass spectrometry can be used to determine the structures of a wide variety of complex molecular species. This analytical technique can also be utilized to determine the structure and composition of solid surfaces.

As early as 1920, the behavior of ions in magnetic fields was described for the purposes of determining the isotopic abundances of elements. In the 1960's, a theory describing fragmentation of molecular species was developed for the purpose of identifying structures of complex molecules. In the 1970's, mass spectrometers and new ionization techniques were introduced which were capable of providing high-speed analysis of complex mixtures and thereby enhancing the capacity for structure determination.

It has become desirable to provide mass spectral analysis using portable or compact instruments. A continuing goal in designing these instruments is to optimize the components of the instrumentation.

SUMMARY OF THE INVENTION

According to one embodiment an ion trap is provided comprising a body having a length and an opening extending from a first end of the body to a second end of the body, the length having a center portion; a first end cap adjacent to the first end of the body, the first end cap having a surface proximate the first end and spaced a distance from the center portion; a second end cap adjacent to the second end of the body, the second end cap having a surface proximate the second end and spaced the distance from the center portion; and wherein the body and end caps define a volume between the surfaces of the first and second end caps and within the opening, the volume comprising the distance and a radius of the opening, wherein the ratio of the radius to the distance is from about 0.84 to about 1.2.

An embodiment also provides a mass spectrometer comprising at least two mass separators in tandem, at least one of the two mass separators comprising an ion trap having a $Z_0/r_0$ ratio between 0.84 and 1.2.

Other embodiments are disclosed as is apparent from the following discussion.

BRIEF DESCRIPTION OF THE DRAWINGS

FIG. 6 is a plot of octapole coefficient relative to quadrupole coefficient as a function of $Z_0/r_0$ ratio for a CIT having an electrode spacing of 0.06 cm according to one embodiment.

FIG. 7 is a plot of quadrupole coefficient as a function of $Z_0/r_0$ ratio for a CIT having an electrode spacing of 0.06 cm according to one embodiment.

FIG. 10 is simulated mass spectral data acquired using a mass separator having a $Z_0/r_0=0.8$.

FIG. 12 is simulated mass spectral data acquired in accordance with one embodiment.

FIG. 13 is experimental mass spectral data acquired in accordance with one embodiment.

FIG. 14 is a comparison of the simulated data of FIG. 12 and the experimental data of FIG. 13 according to an embodiment.

DETAILED DESCRIPTION OF THE PREFERRED EMBODIMENTS

At least some aspects provide processes for designing mass separators and ion traps, methods for producing mass separators and ion traps, mass spectrometers, ion traps, and methods for analyzing samples.

Figure 1:
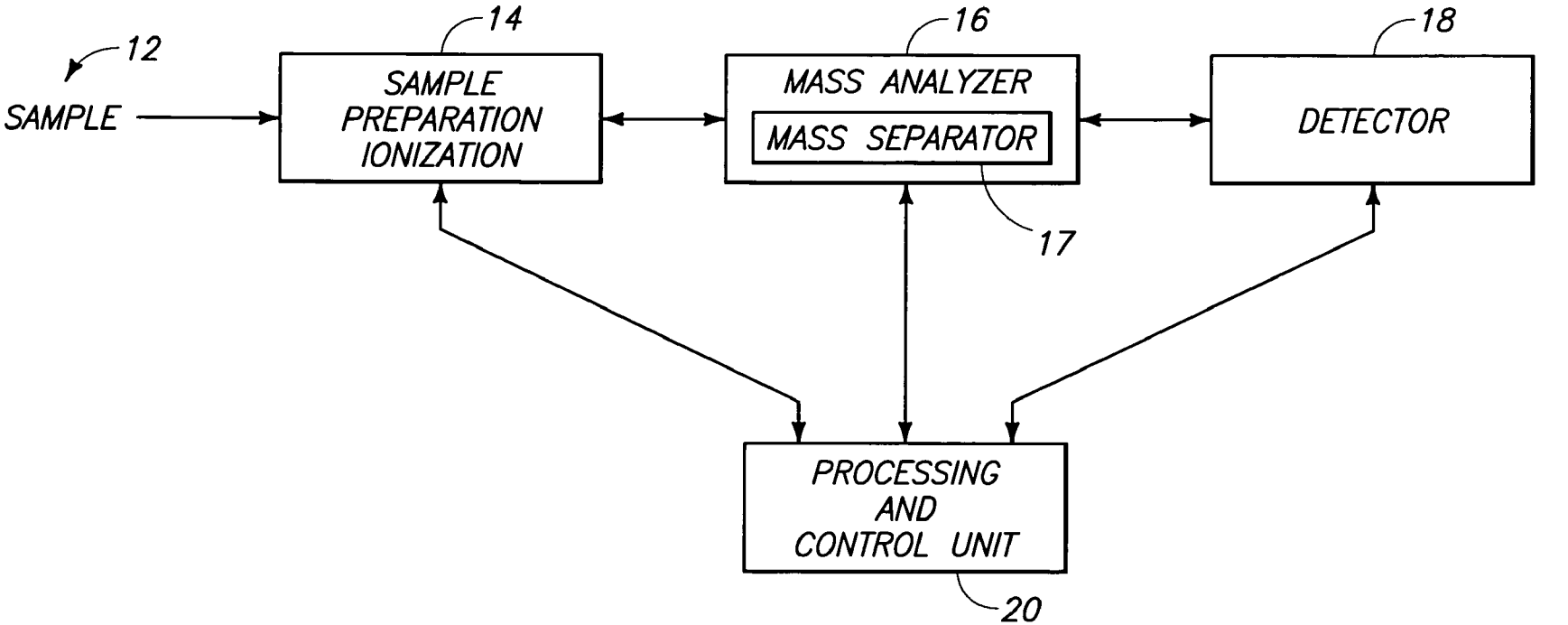
FIG. 1 is a block diagram of a mass spectrometer according to an embodiment.

Referring to FIG. 1, a block diagram of a mass spectrometry instrument 10 is shown. Mass spectrometry instrument 10 includes a sample preparation ionization section 14 configured to receive a sample 12 and convey a prepared and/or ionized sample to a mass analyzer 16. Mass analyzer 16 can be configured to separate ionized samples for detection by detector 18.

As depicted in FIG. 1, a sample 12 can be introduced into section 14. For purposes of this disclosure, sample 12 represents any chemical composition including both inorganic and organic substances in solid, liquid and/or vapor form. Specific examples of sample 12 suitable for analysis include volatile compounds such as, toluene or the specific examples include highly-complex non-volatile protein based structures such as, bradykinin. In certain aspects, sample 12 can be a mixture containing more than one substance or in other aspects sample 12 can be a substantially pure substance. Analysis of sample 12 can be performed according to exemplary aspects described below.

Sample preparation ionization section 14 can include an inlet system (not shown) and an ion source (not shown). The inlet system can introduce an amount of sample 12 into instrument 10. Depending upon sample 12, the inlet system may be configured to prepare sample 12 for ionization. Types of inlet systems can include batch inlets, direct probe inlets, chromatographic inlets, and permeable or capillary membrane inlets. The inlet system may include means for preparing sample 12 for analysis in the gas, liquid and/or solid phase. In some aspects, the inlet system may be combined with the ion source.

The ion source can be configured to receive sample 12 and convert components of sample 12 into analyte ions. This conversion can include the bombardment of components of sample 12 with electrons, ions, molecules, and/or photons. This conversion can also be performed by thermal or electrical energy.

The ion source may utilize, for example, electron ionization (EI, typically suitable for the gas phase ionization), photo ionization (PI), chemical ionization, collisionally activated disassociation and/or electrospray ionization (ESI). For example in PI, the photo energy can be varied to vary the internal energy of the sample. Also, when utilizing ESI, the sample can be energized under atmospheric pressure and potentials applied when transporting ions from atmospheric pressure into the vacuum of the mass spectrometer can be varied to cause varying degrees of dissociation.

Analytes can proceed to mass analyzer 16. Mass analyzer 16 can include an ion transport gate (not shown), and a mass separator 17. The ion transport gate can contain a means for gating the analyte beam generated by the ion source.

Mass separator 17 can include magnetic sectors, electrostatic sectors, and/or quadrupole filter sectors. More particularly, mass separators can include one or more of triple quadrupoles, quadrupole ion traps (Paul), cylindrical ion traps, linear ion traps, rectilinear ion traps (, ion cyclotron resonance, quadrupole ion trap/time-of-flight mass spectrometers, or other structures.

Mass separator 17 can include tandem mass separators. In one implementation at least one of two tandem mass separators can be an ion trap. Tandem mass separators can be placed in series or parallel. In an exemplary implementation, tandem mass separators can receive ions from the same ion source. In an exemplary aspect the tandem mass separators may have the same or different geometric parameters. The tandem mass separators may also receive analyte ions from the same or multiple ion sources.

Analytes may proceed to detector 18. Exemplary detectors include electron multipliers, Faraday cup collectors, photographic and stimulation-type detectors. The progression from analysis from inlet system 3 to detector 7 can be controlled and monitored by a processing and control unit 20.

Acquisition and generation of data according to the present invention can be facilitated with processing and control unit 22. Processing and control unit 22 can be a computer or mini-computer that is capable of controlling the various elements of instrument 10. This control includes the specific application of RF and DC voltages as described above and may further include determining, storing and ultimately displaying mass spectra. Processing and control unit 22 can contain data acquisition and searching software. In one aspect such data acquisition and searching software can be configured to perform data acquisition and searching that includes the programmed acquisition of the total analyte count described above. In another aspect, data acquisition and searching parameters can include methods for correlating the amount of analytes generated to predetermined programs for acquiring data.

Figure 2:
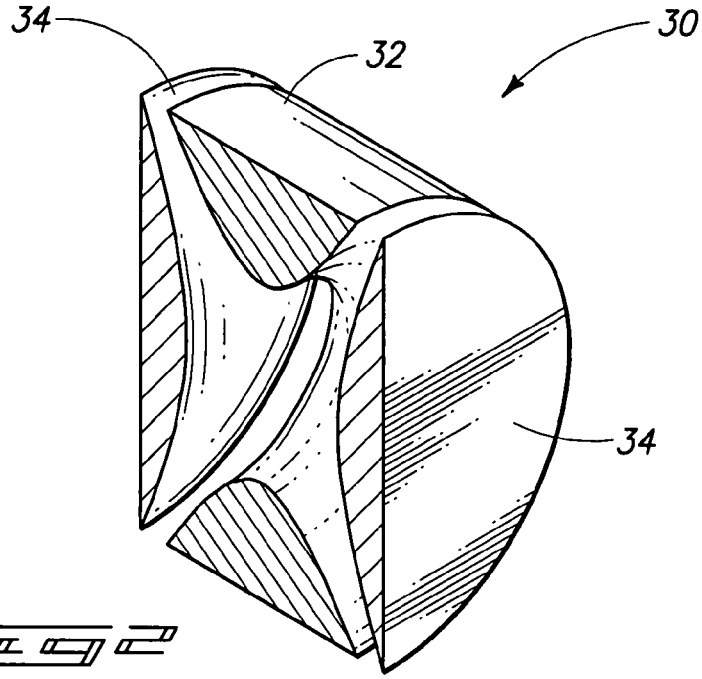
FIG. 2 is a cross-section of a Paul Ion Trap according to an embodiment.
Figure 3:
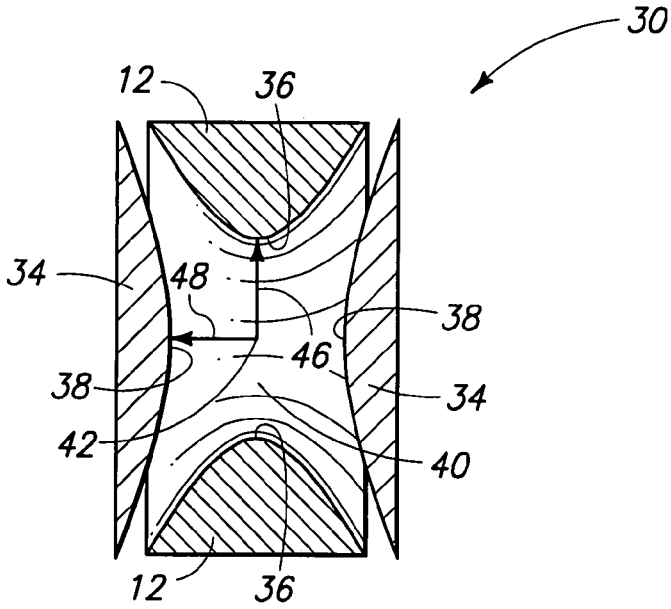
FIG. 3 is an end view of the cross-section of the Paul ion trap of FIG. 2 according to an embodiment.

Exemplary ion traps are shown in FIG. 2-5. Referring to FIG. 2, a Paul ion trap 30 is shown that includes a ring electrode 32 situated between two end-cap electrodes 34. Trap 30 can have a toroidal configuration. As shown in FIG. 3, a cross section of Paul ion trap 30 (e.g., hyperbolic cross-section) shows ring electrode 32 and end caps 34. In this cross-section, ring electrode 32 can be characterized as a set of components and end caps 34 can be characterized as a set of components. Ring electrode 32 includes an inner surface 36 and end caps 34 include an inner surface 38. Ring electrode 32 and end caps 34 define a volume 40 having a center 42. Inner surface 36 is spaced a distance 46 corresponding to half a distance intermediate opposing surfaces 36. Distance 46 can be referred to as $r_0$. Inner surface 38 is spaced a distance 48 half a distance intermediate opposing surfaces 38. Distance 48 can be referred to as $Z_0$.

Figure 4:
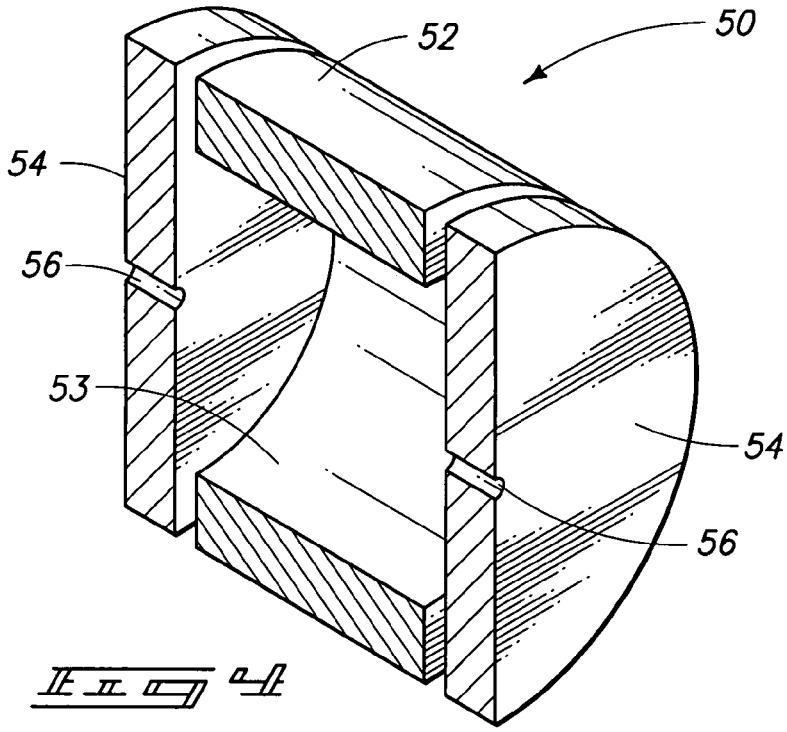
FIG. 4 is a cross-section of a cylindrical ion trap according to an embodiment.

Referring to FIG. 4, a cylindrical ion trap (CIT) 50 is shown. CIT 50 can include a ring electrode 52 having an opening 53. Configurations of ring electrode 52 other than the exemplary depicted ring structure are possible. For example, ring electrode 52 can be formed as an opening a body of material having any exterior formation. Ring electrode 52 can be situated between two end-cap electrodes 54. In an exemplary implementation, electrode 52 can be centrally aligned between electrodes 54.

In one implementation, electrodes 54 can be aligned over and opposing opening 53. Electrodes 54 can be flat and made of a solid material having an aperture 56 therein. Stainless steel is an exemplary solid material while other materials including non-conductive materials are contemplated. Aperture 56 may be centrally located. Electrodes 54 can include multiple apertures 56. Individual electrodes 54 may also be constructed either partially or wholly of a mesh. An exemplary cross-section of CIT 50 is shown in FIG. 5.

Figure 5:
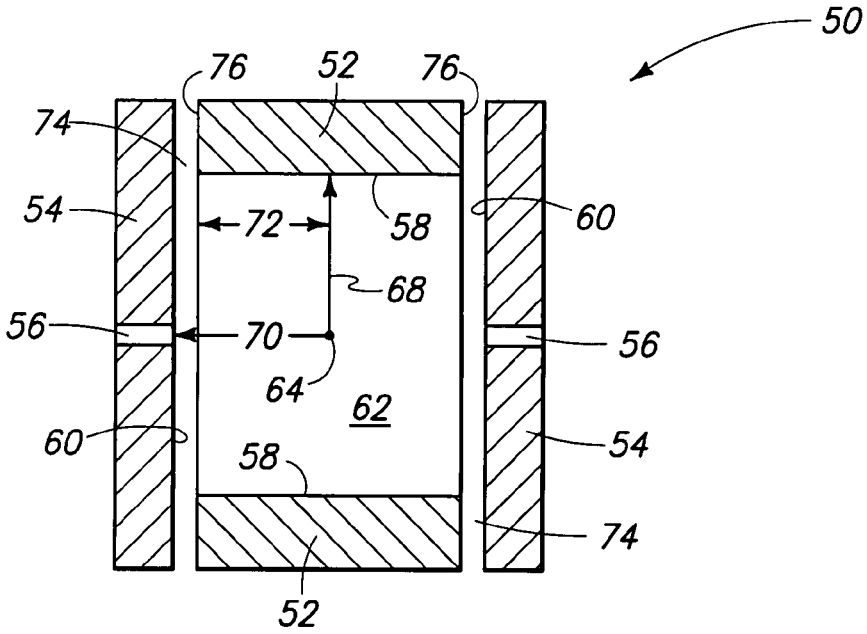
FIG. 5 is an end view of the cross-section of the cylindrical ion trap of FIG. 4.
Figure 4:
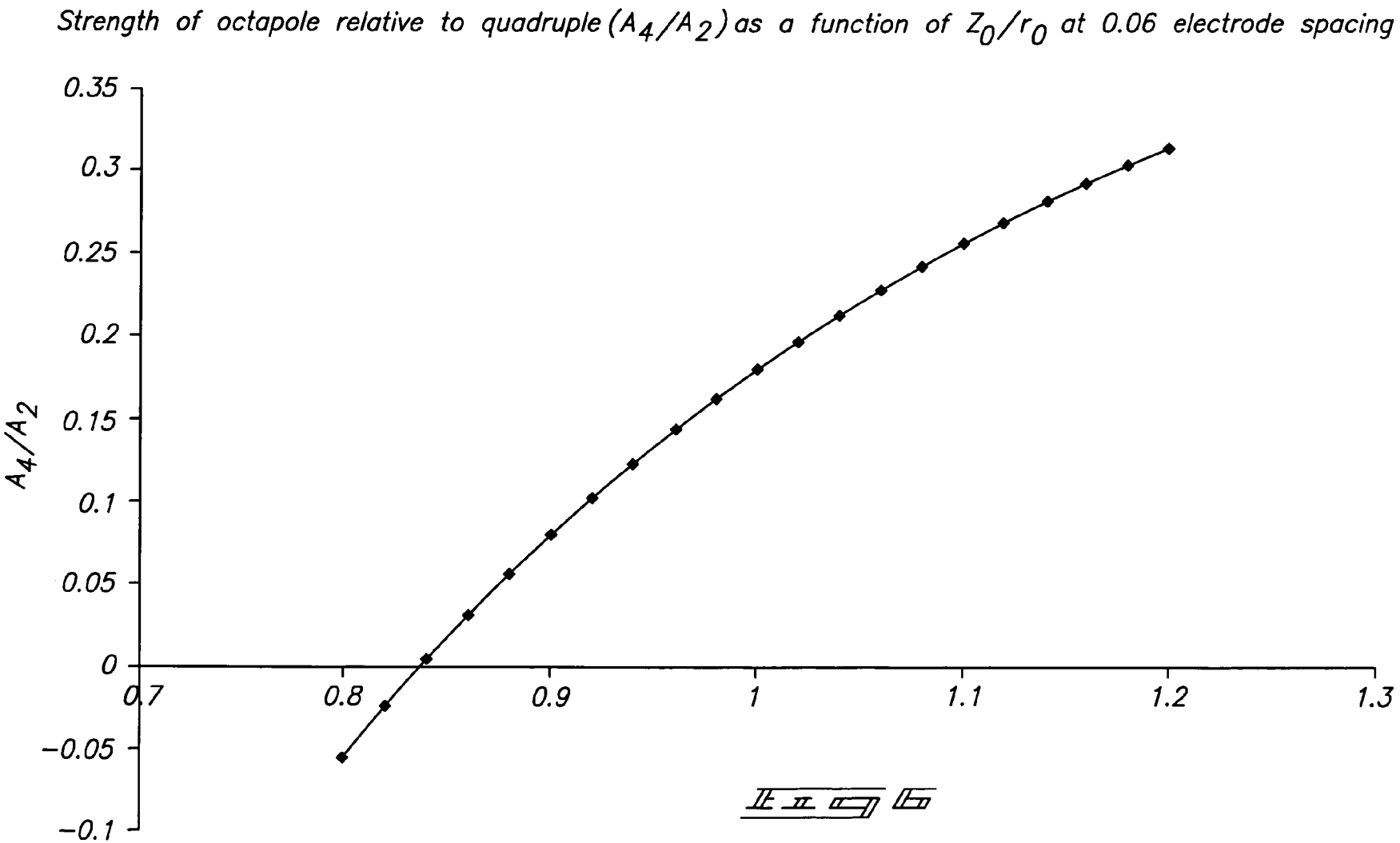

Referring to FIG. 5, ring electrode 52 includes an inner surface 58. Surface 58 can be substantially flat or uniform. End caps 54 have an inner surface 60. Surface 60 can be substantially flat or planar. In this cross-section ring electrode 52 can be characterized as a set of components and end caps 54 can be characterized as a set of components, each having surfaces 58 and 60 respectively. In an implementation, surfaces 58 oppose each other and surfaces 60 oppose each other. Surfaces 58 and surfaces 60 can also be orthogonally related. Ring electrode 52 and end caps 54 define a volume 62 which may have a center 64. In one implementation, openings 56 of end caps 54 can be aligned with center 64. Inner surface 58 is spaced a distance 68 corresponding to half a distance intermediate opposing surfaces 58. Distance 68 can be referred to as $r_0$ and the radius of opening 53. Inner surface 60 is spaced a distance 70 corresponding to half a distance intermediate opposing surfaces 60. Distance 70 can be referred to as $Z_0$. Electrode 52 further includes a half height 72. CIT 50 can have electrode spacing 74 between an end surface 76 of electrode 52 and surface 60. Spacing 74 can be the difference between distance 70 and half height 72. In one implementation, half height 72 can be considered twice the length of electrode 52 with the center of the length being aligned with center 64.

Aspects are described below with respect of the embodiment of FIG. 5 although it is to be understood that the below discussion is also applicable to the embodiment of FIG. 3 or other constructions. Generally, analytes can be stored or trapped using mass separator 17 such as an ion trap through the appropriate application of radio-frequency (RF) and direct current (DC) voltages to the electrodes. For example, with respect to the embodiment of FIG. 5, and by way of example only RF voltage can be applied to ring electrode 52 with end cap electrodes 54 grounded. Ions created inside volume 62 or introduced into volume 62 from an sample preparation ionization section 14, for example, can be stored or trapped in an oscillating potential well created in volume 62 by application of the RF voltage.

In addition to storage, analytes can be separated using mass separator 17 such as an ion trap. For example, and by way of example only, RF and DC voltages can be applied to electrodes 52, and 54 in such a way to create an electric field in volume 62 that trap a single (m/z) value analyte at a time. Voltages can then be stepped to the next m/z value, changing the electric field in volume 62, wherein analytes having that value are trapped and analytes having the previous value are ejected to a detector. This analysis can continue step-wise to record a full mass spectrum over a desired m/z range.

According to an exemplary aspect, the RF and DC voltages can be applied to electrodes 52, 54 in such a way to create electric fields in volume 62 trapping a range of m/z valued analytes simultaneously. The voltages are then changed so that the trapped analytes eject from the ion trap to an external detector in an m/z dependent manner. For example, where no DC is applied and the RF amplitude is increased in a linear fashion, ions of increasing m/z can eject from the trap to a detector. Supplementary voltages may be applied during the RF amplitude ramp (or during scans of other parameters such as RF frequency) to influence ion ejection to the detector. For example, an alternating current (AC) voltage may be applied at the appropriate frequency to resonantly excite the ions and cause their ejection in a process referred to as resonance ejection.

According another implementation, the RF and DC voltages can be applied to electrodes 52, 54 in such a way that a range of m/z values are trapped simultaneously or only a single m/z value is trapped. The ions are detected by their influence on some form of receiver circuit as they undergo characteristic motion in volume 62. Exemplary receiver circuits include circuits that can receive an image current induced by a charged ion cloud on electrodes 52 and/or 54 or on a supplementary electrode and can measure the image current related to the m/z values of the ions.

Exemplary mass separators can be designed to provide optimum mass analysis performance including performance in the mass-selective instability and resonance ejection modes of operation. According to exemplary implementations, an electric field of volume 62 can be controlled by manipulation of mass separator geometry to increase performance. The mass separator geometry can include parameters such as $Z_0$, $r_0$, half height, and/or electrode spacing. The electric field can include a quadrupole field, higher order electric fields or other fields. In exemplary implementations the quadrupole field and higher order fields can be present in volume 62 and may influence analyte motion in volume 62 before and during mass analysis.

According to some embodiments, mass separator geometry parameters are selected to provide increased or optimum performance with respect to a mass spectrometer. The discussion proceeds with respect to an initial method of providing mass separator electric field data. The mass separator electric field data includes data sets of mass separator geometric parameters and corresponding expansion coefficients. According to one implementation a list of mass separator geometric parameters can be generated (e.g., $Z_0$, $r_0$) and applied to Equations 1, 2, and/or 3 below to generate the corresponding expansion coefficients thereby creating the data sets. In one aspect, a designer may select possible values of the geometric parameters for application to the equation for determining corresponding coefficients. Other methods of generating the values of the geometric parameters are possible. According to an exemplary aspect the list is applied to equation 3 below.

An exemplary expression for the potential in an exemplary cylindrical ion trap with no spacing 74 between ring end surface 76 and end-cap electrodes surface 60 and grounding the end cap electrodes 54 with RF voltage applied to ring electrode 52 was developed by Hartung and Avedisian and is given in Equation 1:

$$\Phi(r, z) = 1 - 2\sum_{j=1}^{\infty} \frac{\cosh(x_j z) J_0(x_j r)}{x_j \cosh(x_j z_0) J_1(x_j r_0)} \qquad \text{Equation 1}$$

In this expression, $J_0$ and $J_1$ are Bessel functions of the first kind, and $x_j r_0$ is the $j^{th}$ zero of $J_0(x)$. In one implementation, Equation 1 may be expanded in spherical harmonics to yield Equation 2.

$$\Phi(r,z,\phi)=A_0+A_1 z+A_2(\tfrac{1}{2}r^2-z^2)+A_3(\tfrac{3}{2}r^2 z-z^3)+A_4(\tfrac{3}{8}r^4-3r^2z^2+z^4)+\ldots \qquad \text{Equation 2}$$

In an exemplary implementation, Equation 2 shows that the electric field in the described CIT may be considered as a superposition of electric fields of various order, or pole ("multipole expansion"). The expansion coefficients for $A_n$ where n=0-4 in Equation 2 correspond to the monopole, dipole, quadrupole, hexapole, and octapole components respectively, and the relative magnitude of the coefficients can determine the relative contribution of each field to the overall electric field in the described CIT. According to one implementation, when only the coefficients for n=0 and n=2 are nonzero, the electric field can be considered purely quadrupolar. The even ordered coefficients can be calculated from Equation 3 of Kornienko et al.

$$A_{2n} = \left[\frac{-2}{r_0^{2n}(2n)!}\sum_{j=1}^{\infty} \frac{(x_j r_0)^{2n-1}}{\cosh(x_j z_0) J_1(x_j r_0)} + \delta_{n,0}\right] V_{ring} \qquad \text{Equation 3}$$

Here, $\delta_{n,0}$ is unity if n=0 and is otherwise zero.

According to another method of providing the mass separator electric field data, the corresponding expansion coefficients can be generated numerically from a list of provided geometric parameters using a Poisson/Superfish code maintained at Los Alamos National Laboratory (The Poisson/Superfish code is available at http://laacg1.lanl.gov/laacg/services/possup.html; see also, Billen, J. H. and L. M. Young. Poisson/Superfish of PC Compatibles, in Proceedings of the 1993 Particle Accelerator Conference, 1993, Vol. 2 page 790-792, incorporated herein by reference) coupled with a CalcQuad/Multifit program available in the academic lab of Professor R. Graham Cooks, Purdue University, West Lafayette, Ind. In an exemplary implementation the geometric parameters (e.g., $Z_0$, $r_0$) as well as a potential applied to each component can be entered into a program utilizing the Poisson/Superfish code. The Poisson program can cover volume 62 within the specified geometric parameters with a mesh and then calculate a potential at each point on the mesh corresponding to the specific geometric parameters and corresponding potentials applied to each component (e.g., Poisson electric field data). Harmonic analysis of the Poisson electric field data can then be carried out by inputting the Poisson electric field data into the CalcQuad/Multifit program to yield the expansion coefficients for each of the geometric parameters.

Exemplary data sets can include all of the coefficients (e.g., n=0-8) described above as well as the corresponding geometric parameters (e.g., $Z_0/r_0$). In certain aspects the data sets can include octapole and dodecapole expansion coefficients.

In one embodiment, a range of geometric parameters are selected from the data set that correspond to positive octapole coefficients and the least negative docecapole coefficients. For example, and by way of example only, higher-order fields give large contributions to the overall field resulting in significant degradation of the performance of the mass separator in the mass selective instability mode, particularly if the higher order coefficients are opposite in sign from the $A_2$ term. In one implementation this can be balanced by a small octapole superposition ($A_8/A_2 \leqq 0.05$), which has the same sign as the $A_2$ term (i.e., positive as shown in Equation 2), which may improve performance by off-setting effects of electric field penetration into end-cap apertures 56 that may be present to allow for entrance and egress of ions and/or ionizing agents such as electrons. Exemplary data pairs having this positive octapole coefficient, typically have a negative dodecapole (e.g., $\geqq -0.18$, from 0 to −0.2, or $\geqq -0.05$) coefficient. Data sets having large negative dodecapole coefficients can have corresponding mass separator geometries that subtract from the overall electric field and hence degrade trapping efficiency and mass separator performance. In an exemplary implementation, minimizing the dodecapole coefficient while providing adequate octapole coefficient can offset the effect of the negative dodecapole superposition to some extent. In another exemplary implementation, a larger percentage of positive octapole can optimize CIT 50 performance. The exemplary use of the positive octapole coefficient and the least negative dodecapole coefficient can provide an initial range of ratios.

The range of ratios may be further refined in one example by identifying a minimum and a maximum of the ratios for a given value of spacing 74. Referring to FIG. 6, a plot of octapole relative to quadrupole coefficients ($A_4/A_2$) as a function of $Z_0/r_0$ using an exemplary spacing parameter of 0.06 cm illustrates that the $Z_0/r_0$ ratio should be greater than 0.84 to give positive octapole with a spacing of 0.06 cm between the electrodes. Referring to FIG. 7, quadrupole ($A_2$) as a function of $Z_0/r_0$ at an exemplary 0.06 cm spacing illustrates that as the $Z_0/r_0$ ratio increases, the quadrupole field weakens requiring higher RF amplitude to achieve the same m/z analysis range. At $Z_0/r_0 \sim 1.2$, roughly twice the voltage would be needed to perform mass analysis over a given range than would be needed in an ideal trap ($A_2=1$). Accordingly, in one embodiment a minimum $Z_0/r_0$ ratio of 0.84 and a maximum of 1.2 are defined and may be used in geometries having spacing 74 other than 0.06 cm.

Figure 8:
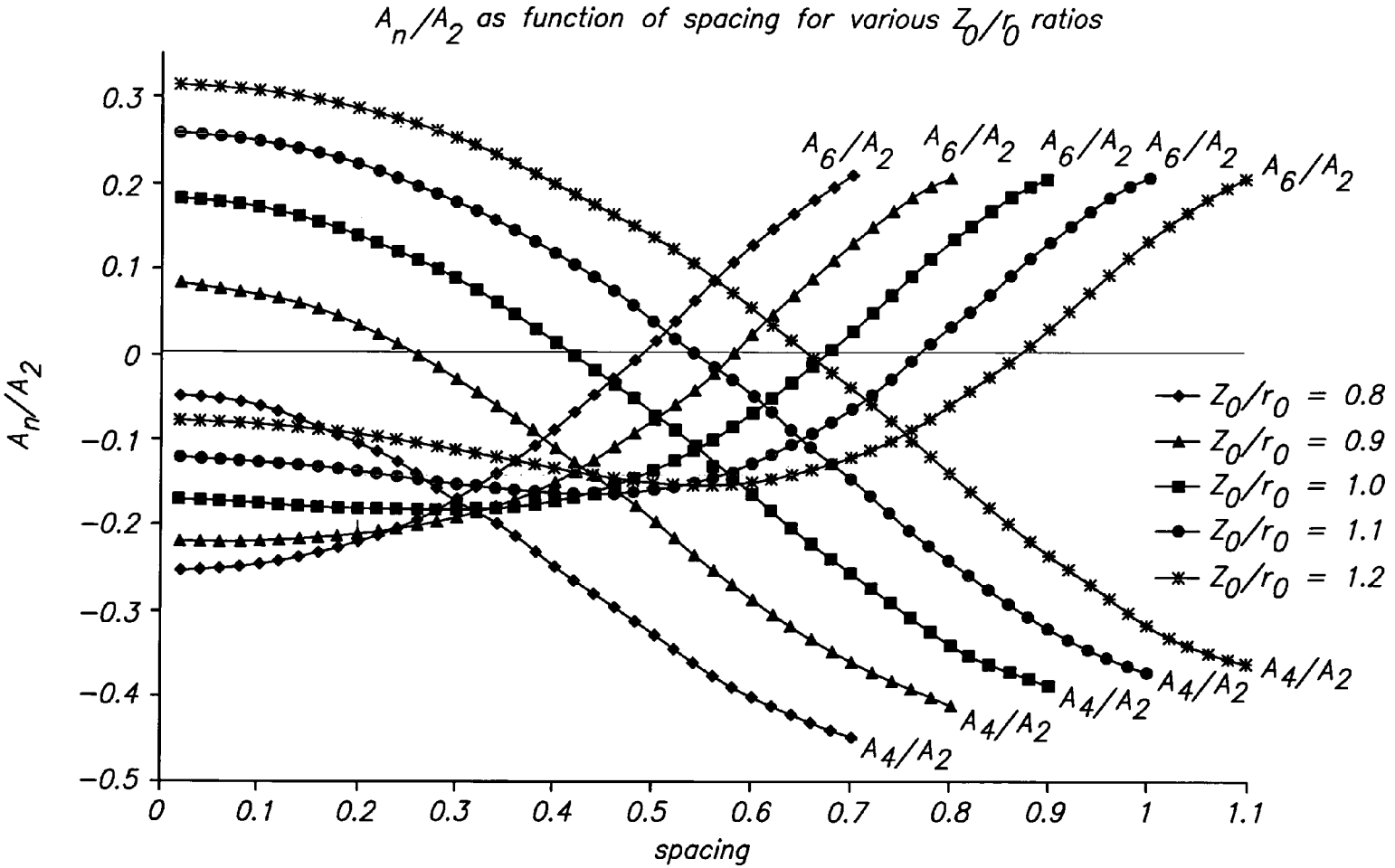
FIG. 8 is a plot of octapole and dodecapole coefficients relative to quadrupole coefficients as a function of electrode spacing for five $Z_0/r_0$ ratios according to one embodiment.

At least one aspect also defines another geometric parameter in terms of spacing 74 intermediate the electrodes. For example, an increase in the space between electrodes (decrease of half-height) can be used to optimize the field by minimizing the negative dodecapole coefficient. FIG. 8 demonstrates $A_n/A_2$ as a function of various $Z_0/r_0$ ratios. As illustrated in FIG. 8, for each value of $Z_0/r_0$, as the spacing is increased, a value of spacing 74 (also referred to as spacer value) is reached where the octapole coefficient $A_4$ crosses zero and becomes negative. These spacer values at the zero crossings give a maximum value of spacing 74 that can be used for a given $Z_0/r_0$. These spacer maximum values and corresponding $Z_0/r_0$ values in the range defined above correspond to the respective zero-crossings in FIG. 8. Above a $Z_0/r_0$ ratio of 1, the relationship between $Z_0/r_0$ and the spacer maximum values may be essentially linear, with the spacer maximum values equal to $1.2(Z_0/r_0)-0.77$ cm.

An exemplary range of data pairs comprising $Z_0/r_0$ ratios and spacer maximum factors is shown in Table 1 below. The spacer maximum factors of the data pairs are usable to calculate spacer maximum values for respective $Z_0/r_0$ ratios to ensure positive octapole superposition. In one embodiment, the spacer maximum factors are scaled to yield the spacer maximum values. For example, a spacer maximum factor may be multiplied by a scaling factor (e.g., $r_0$) to define the spacer maximum value for a respective ratio. The scaling factor can include scales the ηm, μm, mm, or cm, for example. In the described example the spacer maximum factor is multiplied by $r_0$ to achieve scaling and determine the resultant spacer maximum value.

TABLE 1

| $Z_0/r_0$ | Spacer Maximum Factors |
|---|---|
| 0.84 | 0.08 |
| 0.86 | 0.16 |
| 0.88 | 0.22 |
| 0.90 | 0.26 |
| 0.92 | 0.30 |
| 0.94 | 0.33 |
| 0.96 | 0.36 |
| 0.98 | 0.39 |
| 1.00 | 0.42 |
| 1.02 | 0.45 |
| 1.04 | 0.47 |
| 1.06 | 0.50 |
| 1.08 | 0.52 |
| 1.10 | 0.55 |
| 1.12 | 0.57 |
| 1.14 | 0.59 |
| 1.16 | 0.62 |
| 1.18 | 0.64 |
| 1.20 | 0.66 |

According to an embodiment, a mass separator may be produced by aligning the first and second sets of components as shown and described in FIG. 5 above with a ratio of $Z_0$ to $r_0$ of from about 0.84 to about 1.2. In one example, a desired $r_0$ and $Z_0/r_0$ ratio may be chosen based upon design criteria (e.g., available RF power supply, gas-tightness, gas throughput, minimization of gas pumping). $Z_0$ is determined from the selected $r_0$ and ratio. The spacing 74 is determined from the maximum spacer factor times the scaling factor (e.g., $r_0$). The utilized spacing 74 may be equal to or less than the maximum spacer factor times $r_0$ in one embodiment.

Instrument 10 can be calibrated with a known composition such as perfluorotri-n-butylamine (pftba) or perfluorokerosene. Once calibrated, the instrument can provide mass spectra of analytes produced according to the methods described above.

Simulation of instruments 10 designed in accordance with disclosed aspects versus other designs is provided below. The results of the simulations are provided in FIGS. 9-12 and 14.

Mass spectral data simulations were performed using an ITSIM 5.1 program available from the laboratory of Prof. R. Graham Cooks at Purdue University. (Bui, H. A.; Cooks, R. G. Windows Version of the Ton Trap Simulation Program ITSIM: A Powerful Heuristic and Predictive Tool In Ion Trap Mass Spectrometry J. Mass Spectrom. 1998, 33, 297-304, herein incorporated by reference). The ITSIM program allows for the calculation of trajectories (motion paths) of ions stored in ion trap mass spectrometers, including cylindrical ion traps (CITs). The motion of many thousands of ions can be simulated, to allow for a statistically valid, realistic comparison of the simulated ion behavior with the data that are obtained experimentally. Full control of experimental variables, including the frequency and amplitude of the RF trapping voltage and the frequencies and amplitudes of additional waveforms applied to the ion trap end caps is provided by the simulation program. A collisional model that allows for simulation of the effects of background neutral molecules present in the ion trap that may collide with the ions is also provided. To perform a simulation, the following steps may be performed: 1) the characteristics (e.g. mass, charge, etc.) of the ions to be simulated are specified, 2) the characteristics of the ion trap (e.g. size) are specified, 3) the characteristics of the experiment to be simulated (e.g. voltages applied to the CIT) are specified, and 4) the motion of the ions under these conditions are calculated using numerical integration. In the sections that follow, exemplary details for each of these steps is given.

1) The Ions

Three ensembles of ions were created to simulate the ions generated via electron ionization of toluene ($C_7H_8$). The ions were generated randomly in time during the first three microseconds of the simulation, with the characteristics detailed in Table 2:

TABLE 2

Characteristics of ions in simulation data

| | Ion Ensemble 1 | Ion Ensemble 2 | Ion Ensemble 3 |
|---|---|---|---|
| mass (m) | 65 Da | 91 Da | 92 Da |
| Charge (z) | 1 | 1 | 1 |
| Number of ions | 250 | 1500 | 750 |
| initial radial | 0 ± 0.3 mm, | 0 ± 0.3 mm, | 0 ± 0.3 mm, |
| initial axial | 0 ± 0.15 mm, | 0 ± 0.15 mm, | 0 ± 0.15 mm, |
| initial velocity | 0 m/sec. | 0 m/sec. | 0 m/sec. |

2) The Cylindrical Ion Traps

To yield the most accurate comparison between the simulation and the experiment, the cylindrical ion traps used in the simulations described here were defined by calculating an array of potential values for the specific CIT geometry under study. This method allows for the effects of each geometry detail, such as electrode spacing and end-cap hole size, to be most accurately represented. To achieve this using the ITSIM program, the geometric coordinates for each electrode of the trap are specified as x,y pairs in a text file, together with the potential applied to each electrode. This file can then be loaded into a CreatePot program (available from the laboratory of Professor R. Graham Cooks, Purdue University, West Lafayette, Ind., and based on the Poisson/Superfish code described above) that calculates the potential at each point on a rectangular grid within the ion trap volume, and this array of potential points is then loaded into memory for use in the ion trajectory calculation. For the simulations described here, a grid of approximately 100,000 points was used to represent the potential distribution in the CIT. Before the start of a simulation, the components of the electric field vector are obtained by taking the derivative of the potentials on the grid points using centered differencing. During the simulation, the electric field is determined at each time step for each ion position by bilinear interpolation from the electric field components on the adjacent grid points.

For the simulation data shown below, each aspect of the CIT geometry was kept constant except for the parameter under test. Potential array files were generated for each geometry and used to simulate the trajectories of the same ensembles of ions, as defined above, using the same simulation conditions defined below. In this way, the effects of the geometry change on the ion motion, and ultimately on the mass spectrum, could be measured.

3) The Characteristics of the Experiment Simulated

An ion trap experiment is defined by the voltages applied to the electrodes of the trap, and how those voltages vary as a function of time. For the simulations performed here, the voltages were applied in two segments, with a total simulation length of 5.13 ms. The details of the voltages applied during each segment are given in Table 3.

TABLE 3

| Electrode | Segment 1 (0.5 ms duration) | Segment 2 (4.63 ms duration) |
|---|---|---|
| Ring | Sine<br>Freq: 1.5 MHz<br>Amp: constant to yield trap low-mass cutoff (LMCO) = 50 (actual voltage amplitude varied with geometry such that lowest mass trapped at $q_z$ = 0.64 was always m/z 50) | Sine<br>Freq: 1.5 MHz<br>Amp: ramped from LMCO 50 to LMCO 100 (actual voltage varied, scan rate was always 10.8 Da/ms) |
| End Caps | no voltage applied | Sine<br>Freq: 375 kHz<br>Amp: ramped from 1.84 V to 3.41 V (chosen to match experiment) |

Segment 1 is a 0.5 ms stabilization time, to allow the ions to come to equilibrium with the background gas through collisions. Segment 2 is a mass analysis ramp using the mass selective instability mode with resonance ejection. The trapping voltage on the ring electrode is ramped in amplitude during this segment to bring ions to resonance with the voltage applied to the end caps, in order of m/z ratio. When the ions reach the resonance point, they are excited by the voltage on the end caps and are ejected from the trap.

The simulations performed here included the effects of background gas present in the ion trap. The gas was assumed to be mass 28 (e.g. nitrogen to simulate an air background) at a temperature of 300 K and a pressure of $6\times10^{-5}$ Torr, to match the experiments. At each time step of the simulation, a buffer gas atom is assigned a random velocity generated from a Maxwell-Boltzmann distribution. A random number from a uniform distribution is then compared to the collision probability to determine if a collision occurs. The collision probability is calculated assuming a Langevin collision cross section, with the hard-sphere radius of the ions equal to 50 $Å^2$ and the polarizability of the neutral gas equal to 0.205 $Å^3$. The simulation assumes that the gas velocity is randomly distributed, and also assumes that any scattering of the ion trajectories that may occur is in a random direction. Only elastic collisions are considered, i.e. only kinetic energy, but not internal energy, is transferred during the collision.

4) Calculation of Ion Motion

ITSIM calculates the trajectories of each ion in the ensemble by numerically integrating the equation of motion under the conditions specified above. When an ion leaves the ion trap volume, or at the end of the simulation, the location of each ion, and the time it has left the trap if applicable, is recorded. For the simulations performed here, the integration was performed using a fourth-order Runge-Kutta algorithm with a base time step size of 10 ns. The voltages applied to the traps were varied as described above, and the location of each ion in the trap was calculated every 10 ns. For the simulations performed here, most of the ions had ejected from the trap through the end-cap holes, and hence were recorded to have left the trap and struck a "detector" placed just outside the trapping volume.

In the mass-selective instability with resonance ejection mode of operation which is simulated here, ions are ejected from the ion trap in order from lowest to highest m/z ratio, as described above. By plotting the ejection time of the ions as a function of ion number, a mass spectrum of the ions can be generated. The simulated data for ion number at the detector vs. ejection time were exported to Excel for plotting and calibration to generate the mass spectra given in the figures below.

Figure 9:
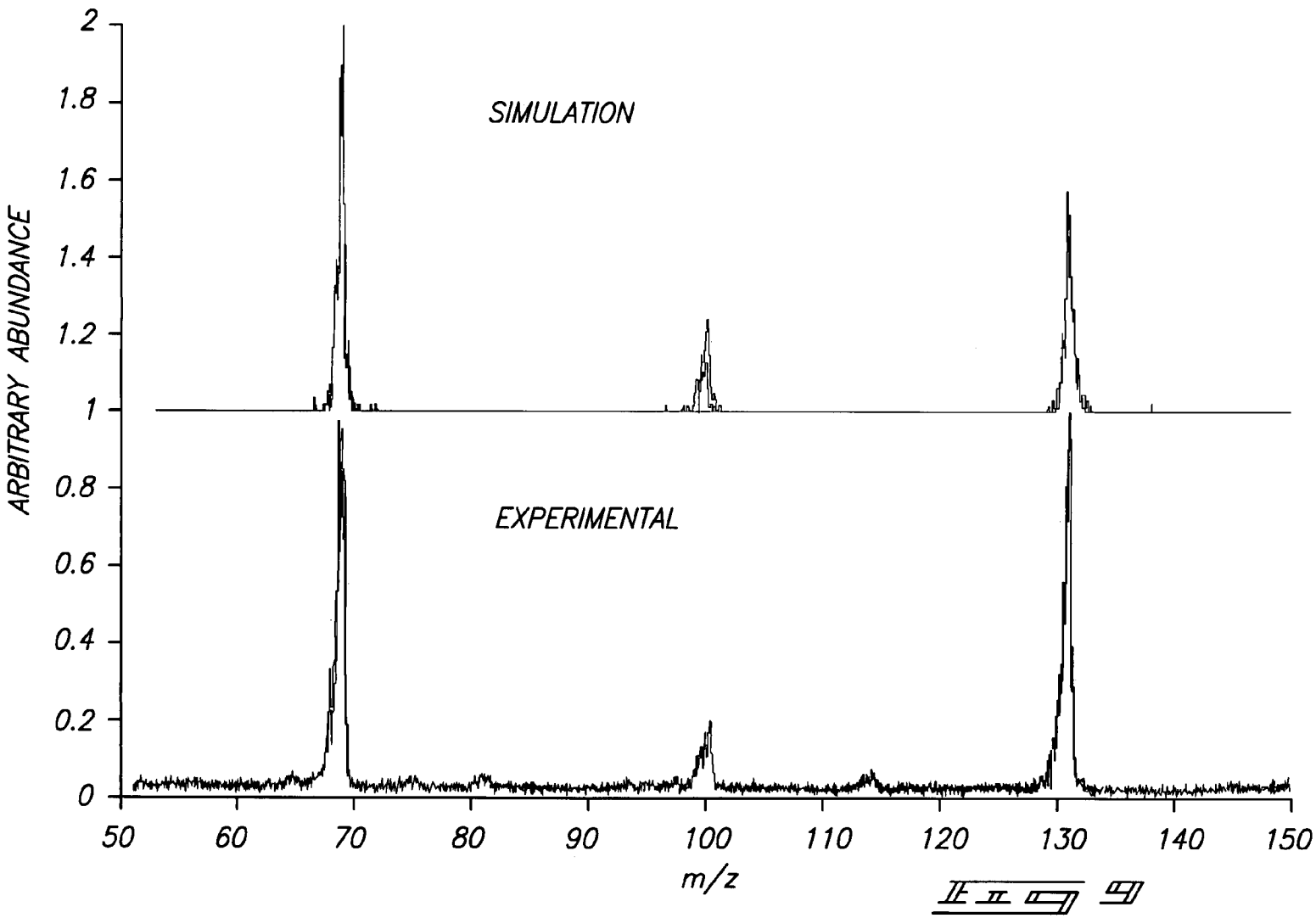
FIG. 9 is a comparison of simulation and experimental mass spectral data acquired in accordance with one embodiment.
Figure 11:
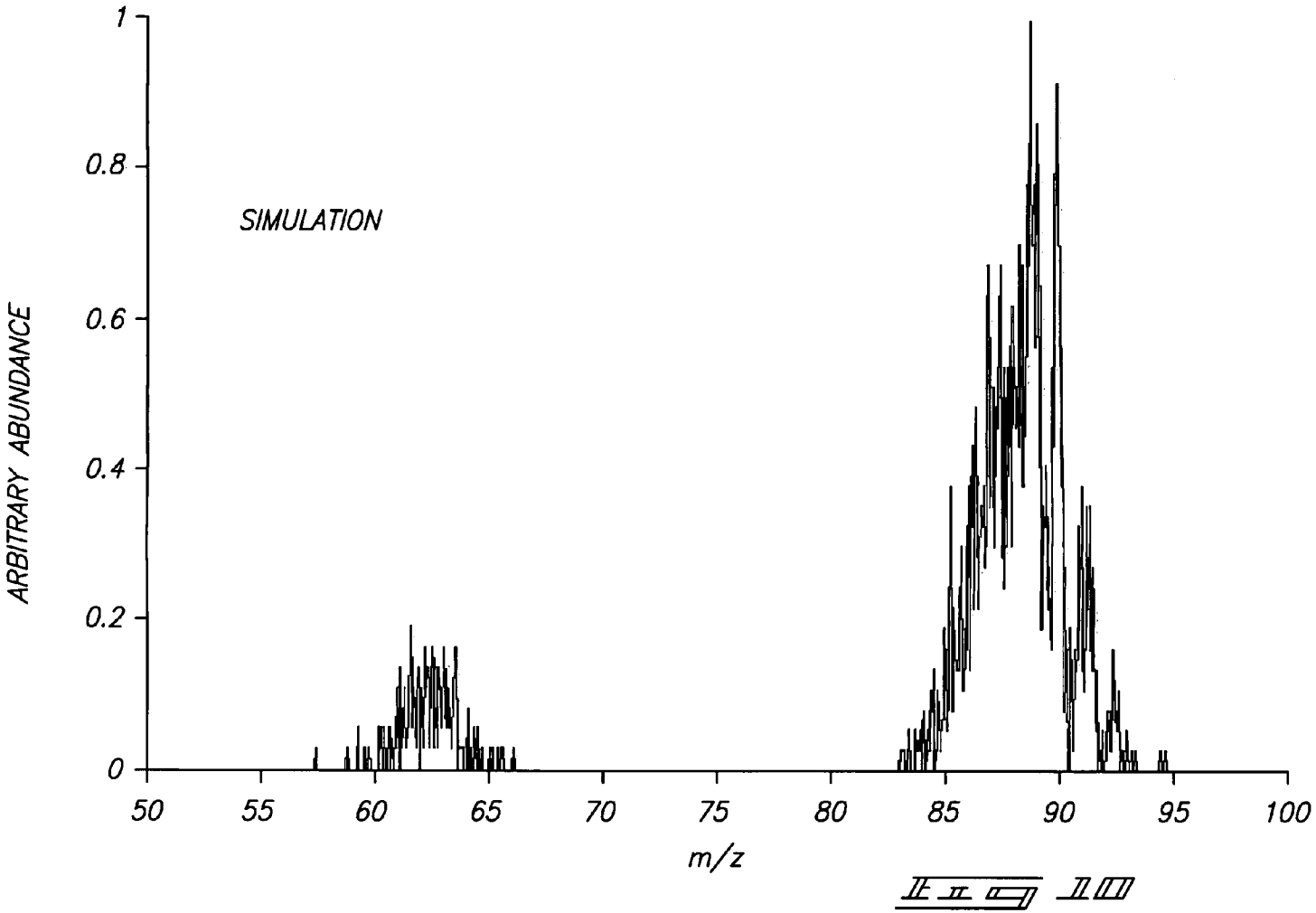
Figure 11:
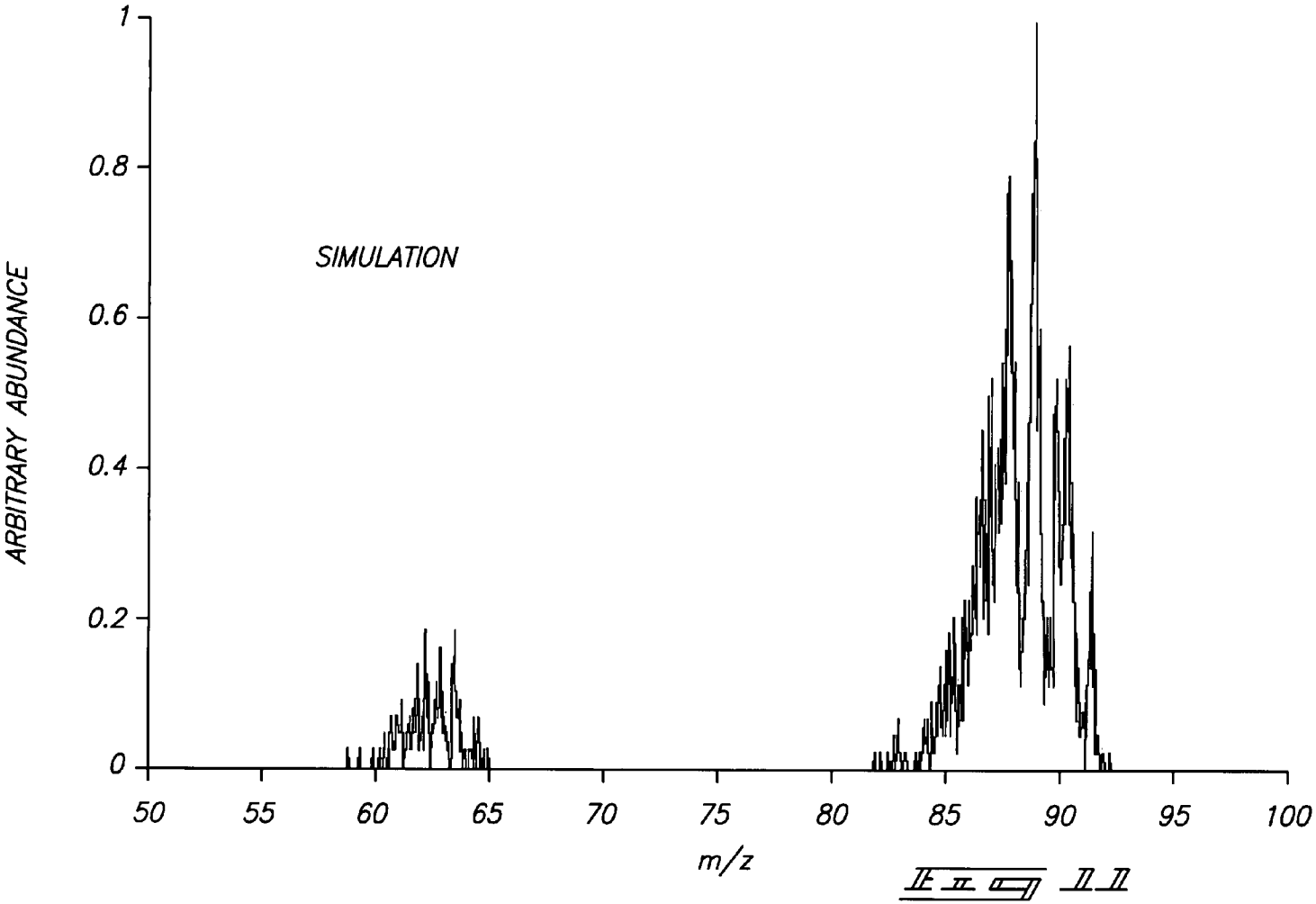
Figure 11:
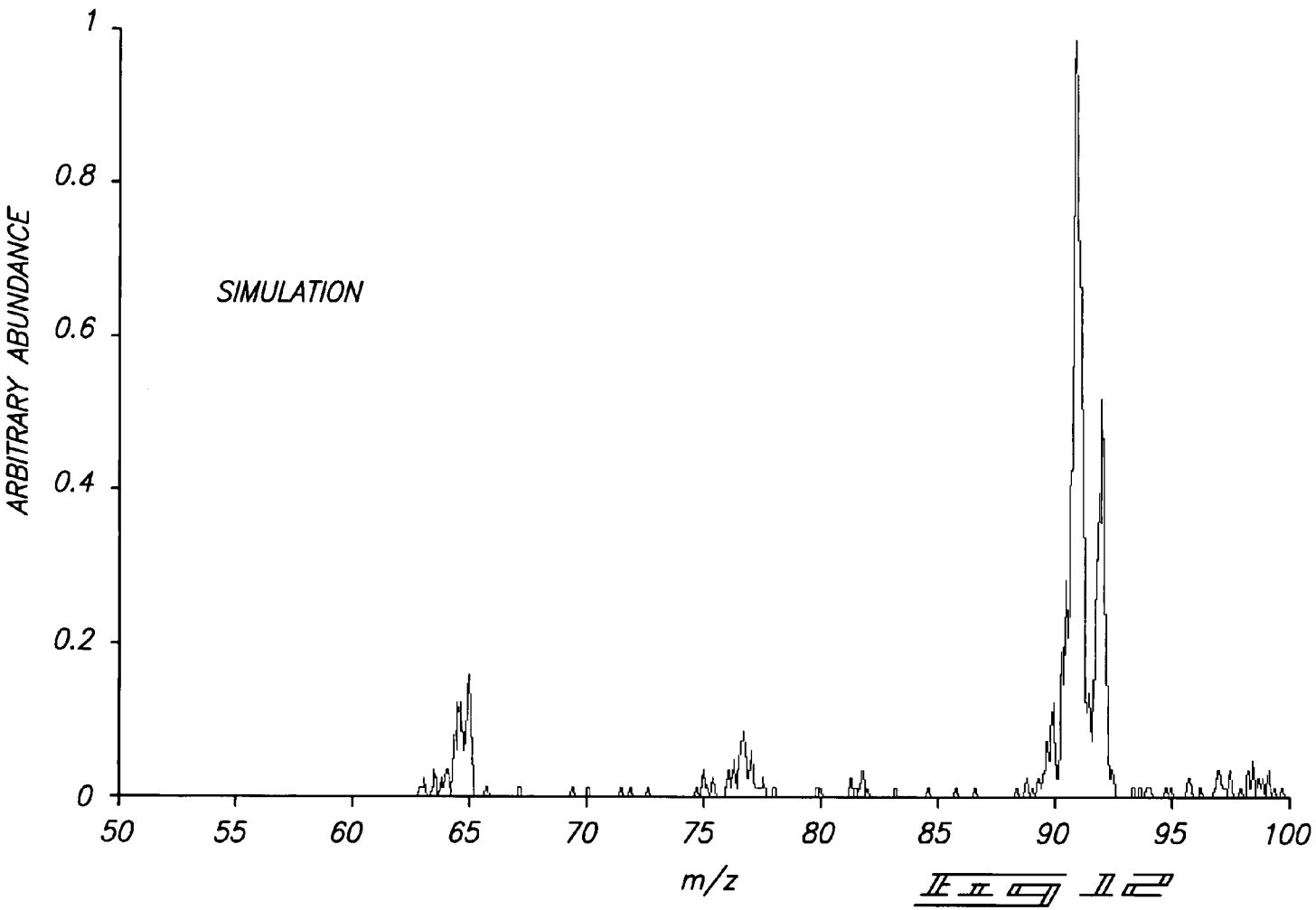
Figure 11:
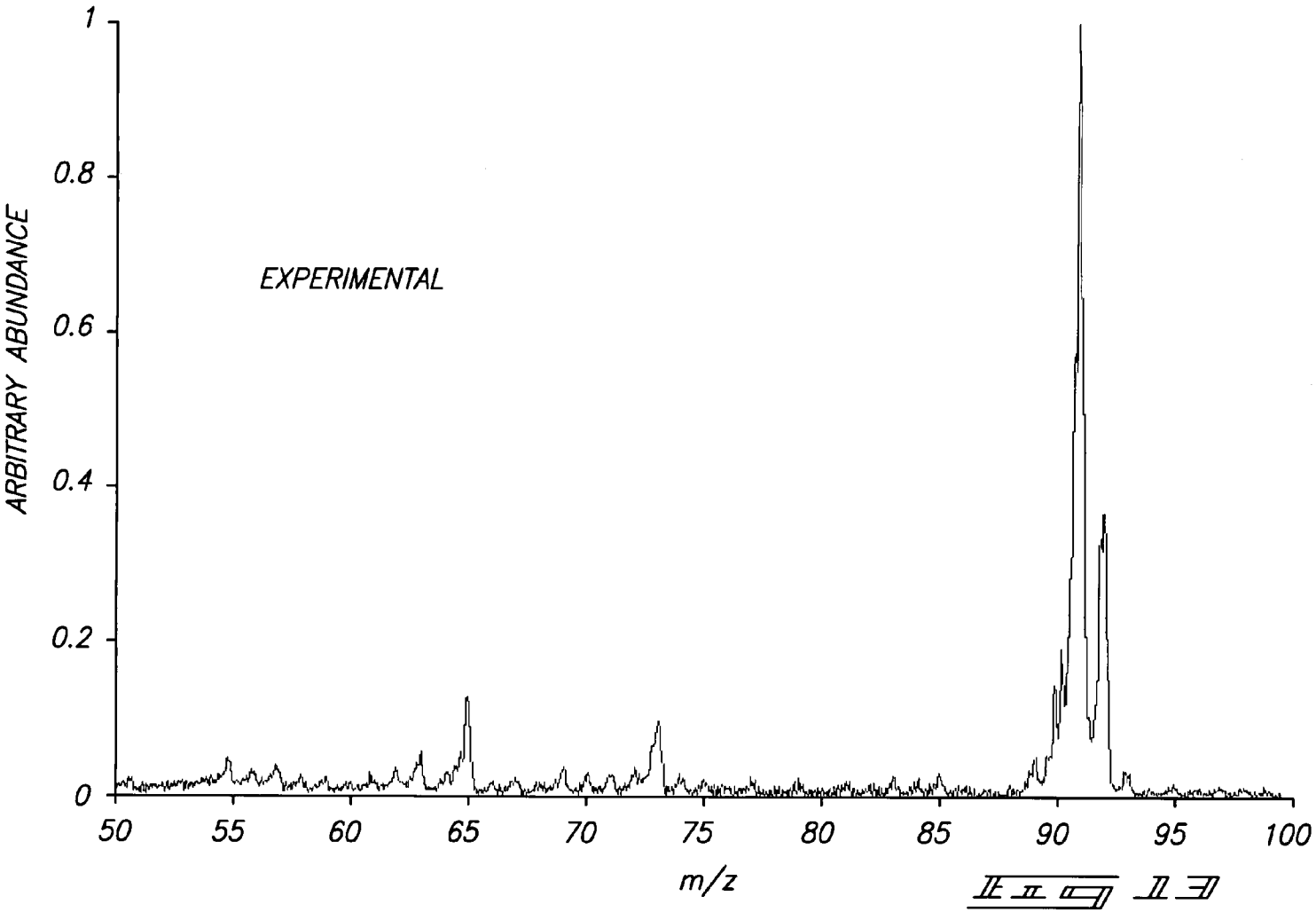
Figure 11:
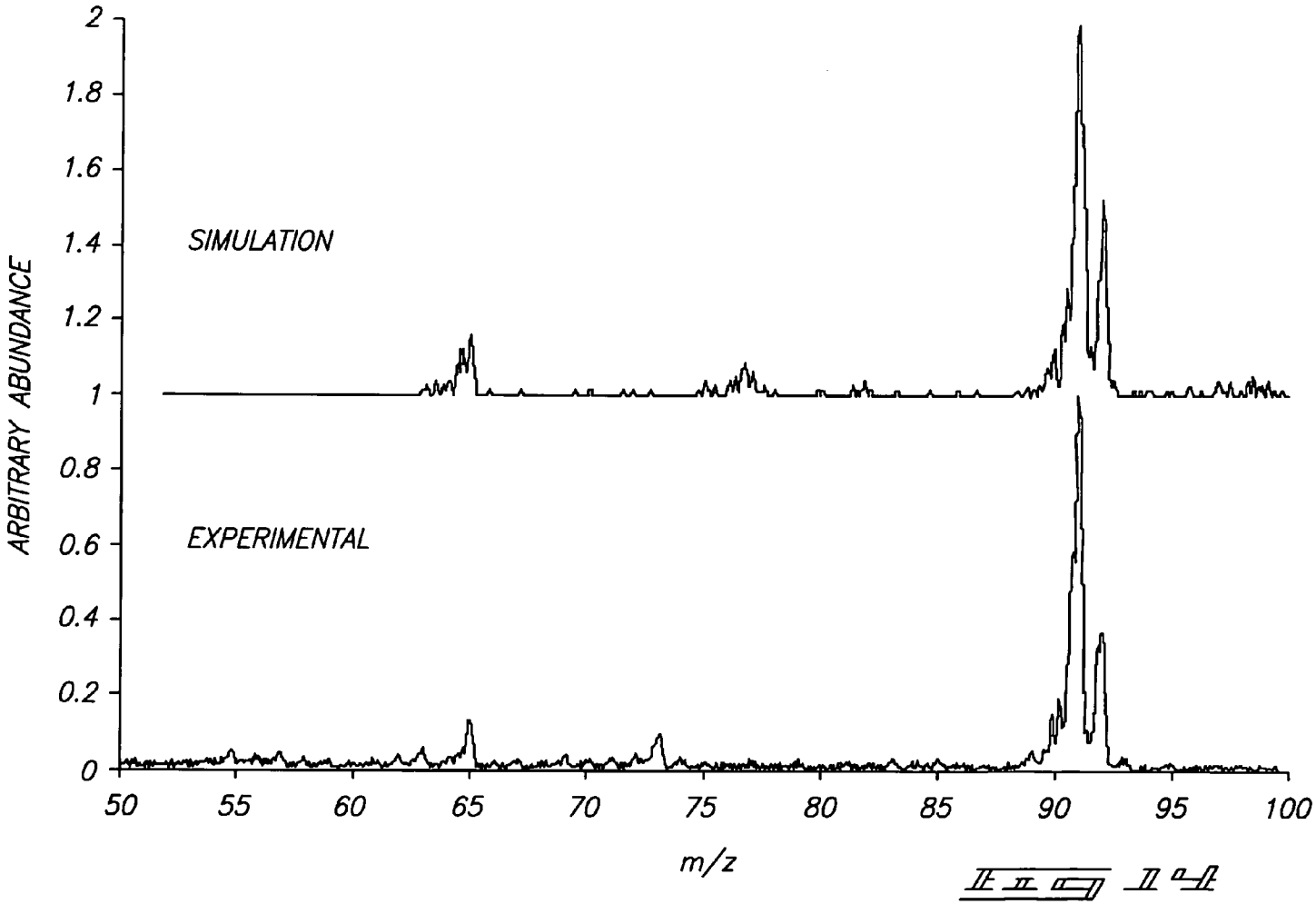

Experimental data was also obtained from exemplary instruments 10 fabricated according to aspects of the disclosure. Experimental results are shown in FIGS. 9, 13, and 14.

Experimental Details

The experimental data given in the figures below was generated on a Griffin Analytical Technologies, Inc. Minotaur Model 2001A CIT mass spectrometer. (Griffin Analytical Technologies, West Lafayette, Ind. (Griffin)). The CIT used in the Griffin mass spectrometer to record the data presented below has a ring electrode radius, $r_0$ of 4.0 mm, a center-to-end cap spacing, $Z_0$ of 4.6 mm, and a ring-to-end cap spacing of 1.28 mm. The CIT, along with the electron generating filament and the lenses used to transport the electrons to the CIT for ionization, are housed in a vacuum chamber that is pumped by a Varian V70LP turbomolecular pump, backed by a KNF Neuberger 813.5 diaphragm pump. The pressure inside this chamber can be set using a Granville-Phillips Model 203 variable leak valve; for the data collected here, the chamber pressure was set to $6\times10^{-5}$ Torr of ambient room air, as measured on a Granville-Phillips 354 Micro-Ion® vacuum gauge module.

With this instrument, volatile gas-phase samples are introduced into the vacuum chamber via a polydimethylsiloxane (PDMS) capillary membrane located inside the chamber. Organic compounds, such as toluene, are drawn through the inside of the membrane, permeate into the membrane material, and then desorb from the outside surface of the membrane into the vacuum chamber. The main constituents of air, such as oxygen and nitrogen, are rejected by the membrane and hence do not enter the vacuum chamber. The analyte molecules that enter the vacuum chamber are ionized inside the CIT by an electron beam that is generated from a heated filament and is then directed into the trap with a set of three lenses. The trapped ions are allowed to cool via collisions with background air, and are then scanned from the trap to an external detector in the mass-selective instability with resonance ejection mode as described above.

Toluene was introduced to the instrument by drawing the headspace vapors of the neat liquid through a one centimeter PDMS membrane at a flow rate of approximately 2 L/min using a KNF Neuberger MPU937 diaphragm pump. The membrane was at ambient temperature. The toluene molecules were ionized in the CIT for 50 ms with the 1.5 MHz trapping RF set to a voltage that corresponded to a LMCO in the trap of m/z 50 (note that for the Griffin CIT, the LMCO values are specified for $q_z$=0.64, not $q_z$=0.908 as is typical for most standard ion traps). The ions were then allowed to cool for 25 ms at LMCO 50 before mass analysis. For mass analysis, the RF on the ring electrode was ramped from a LMCO of 50 to a LMCO of 150, at a scan rate of 10.7 Da/ms. During mass analysis, the end cap sine voltage of 375 kHz was ramped in amplitude from a starting value of 0.95 V to 1.85 V. Note that the end caps are connected in such a way that when one end cap has a positive voltage applied, the other has a corresponding negative voltage applied, so that the potential between the end caps is actually twice the amplitude of the voltage applied between each end cap and ground. This accounts for the factor-of-two difference in the end cap voltage specified here in the experimental section and that specified above in the simulations. The ions were detected with a combination conversion dynode/electron multiplier detector. The dynode was held at −4 kV, and the electron multiplier at −1.2 kV.

Simulation and Experimental Data

FIG. 9 is a comparison of simulated and experimental mass spectra for perfluoro tributalamine (PFTBA) collected under identical conditions using a cylindrical ion trap with $Z_0$=4.6 mm, $r_0$=4.0 mm ($Z_0/r_0$=1.15), and electrode spacing=1.28 mm.

FIG. 10 is a simulated mass spectrum of toluene calculated for a cylindrical ion trap with $Z_0$=3.2 mm, $r_0$=4.0 mm ($Z_0/r_0$=0.8), and spacing=0.6 mm, illustrating that when the condition 0.84 is not met, the mass spectral performance of the CIT is poor; i.e. the peaks are broadened and are not well-resolved.

Figure 11:
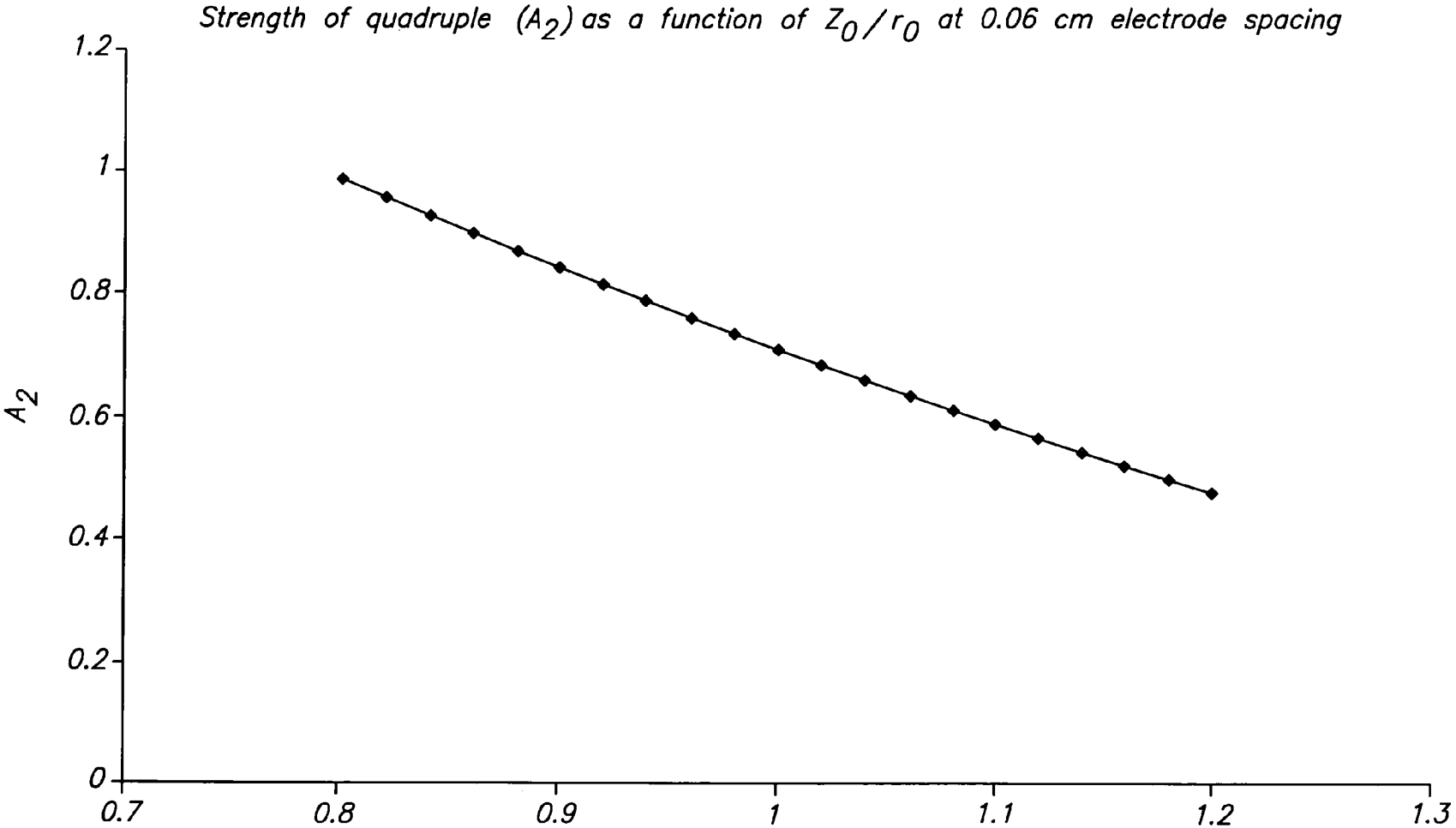
FIG. 11 is simulated mass spectral data acquired using a mass separator having a spacing of 2.56 mm.

FIG. 11 is a simulated mass spectrum of toluene calculated for a cylindrical ion trap with $Z_0$=4.6 mm, $r_0$=4.0 mm ($Z_0/r_0$=1.15), and spacing=2.56 mm, illustrating that when the spacer is greater than that defined in Table 1 for this value of $Z_0/r_0$ the mass spectral performance is poor; i.e. the peaks are broadened and are not well-resolved.

FIG. 12 is a simulated mass spectrum of toluene calculated for a cylindrical ion trap with $Z_0$=4.6 mm, $r_0$=4.0 mm ($Z_0/r_0$=1.15), and spacing=1.28 mm, illustrating that when the spacer is within the range defined in Table 1 for this value of $Z_0/r_0$, the mass spectral performance is improved; i.e. the peaks are narrower and more defined, and the signals for ions of m/z 91 and m/z 92 are well-resolved.

FIG. 13 in an experimental mass spectrum of toluene obtained on the Griffin mass spectrometer using a cylindrical ion trap with $Z_0$=4.6 mm, $r_0$=4.0 mm ($Z_0/r_0$=1.15), and spacing=1.28 mm, illustrating that, when the CIT is constructed according to the geometry specifications defined above, the mass spectral performance is improved.

FIG. 14 is a comparison of the simulated and experimental data from FIGS. 12 and 13.

The invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with equitable doctrines.

What is claimed is:

1. A mass spectrometer comprising:

a sample inlet;

a mass separator configured to receive at least a portion of a sample from the sample inlet, the mass separator comprising first and second sets of electrode components, individual ones of the components comprising a surface, wherein, in a cross section of the mass separator, the surfaces of the first set of components oppose each other, the surfaces of the second set of components oppose each other, wherein the opposing surfaces of the first and second sets of components define a volume comprising a first distance corresponding to a half a distance intermediate opposing surfaces of the first set of components and a second distance corresponding to a half a distance intermediate opposing surfaces of the second set of components, wherein a ratio of the first distance to the second distance comprises from about 0.84 to about 1.2, and an electrode spacing distance between the first components, the electrode spacing distance being less than the product of a spacer maximum factor times the second distance; and a detector configured to receive and detect ions from the mass separator.

2. The mass spectrometer of claim 1 wherein the sample inlet comprises a capillary membrane.

3. The mass spectrometer of claim 1 wherein the mass spectrometer is configured to ionize at least a portion of the sample and separate at least a portion of the ionized sample.

4. The mass spectrometer of claim 1 wherein the mass separator comprises an ion trap.

5. The mass spectrometer of claim 4 wherein the ion trap comprises a cylindrical ion trap.

6. The mass spectrometer of claim 5 wherein the surface of the component of the first set of components comprises an inner surface of the at least one of the end caps of the cylindrical ion trap and the surface of the component of the second set comprises an inner surface of the ring electrode of the cylindrical ion trap.

7. The mass spectrometer of claim 6 wherein the end caps further comprise an opening.

8. The mass spectrometer of claim 7 wherein the end caps comprise stainless steel mesh.

9. The mass spectrometer of claim 5 wherein the cylindrical ion trap comprises stainless steel.

10. The mass spectrometer of claim 6 wherein the opening is aligned with the volume center.

11. The mass spectrometer of claim 1 wherein the detector comprises an electron multiplier detector.

* * * * *

UNITED STATES PATENT AND TRADEMARK OFFICE

CERTIFICATE OF CORRECTION

PATENT NO. : 7,582,867 B2
APPLICATION NO. : 11/906661
DATED : September 1, 2009
INVENTOR(S) : Wells et al.

It is certified that error appears in the above-identified patent and that said Letters Patent is hereby corrected as shown below:

Column 2, Line 8 – Replace "Paul Ion Trap" with --Paul ion trap--.

Column 3, Line 35 – Replace "traps (," with --traps,--.

Column 5, Line 31 – Replace "According another" with --According to another--.

Signed and Sealed this

Seventeenth Day of August, 2010

David J. Kappos

David J. Kappos
*Director of the United States Patent and Trademark Office*